US006578729B2

(12) United States Patent
Grinberg

(10) Patent No.: US 6,578,729 B2
(45) Date of Patent: Jun. 17, 2003

(54) GLOVE CARTRIDGE AND METHOD OF DONNING A DISPOSABLE GLOVE

(75) Inventor: Daniel Grinberg, New York, NY (US)

(73) Assignee: FoodHandler Inc., Westbury, NY (US)

( * ) Notice: Subject to any disclaimer, the term of this patent is extended or adjusted under 35 U.S.C. 154(b) by 0 days.

(21) Appl. No.: 09/934,110

(22) Filed: Aug. 21, 2001

(65) Prior Publication Data

US 2002/0060221 A1 May 23, 2002

Related U.S. Application Data

(63) Continuation-in-part of application No. 09/478,654, filed on Jan. 6, 2000, now abandoned.

(51) Int. Cl.[7] ..... B65H 3/58
(52) U.S. Cl. ..... 221/26; 2/159
(58) Field of Search ..... 221/26, 27, 28, 221/33, 46, 34, 197; 2/159, 160, 161.6, 161.7, 169; 211/49.1, 50, 59.2

(56) References Cited

U.S. PATENT DOCUMENTS 4,113,109 A * 9/1978 Donnelli et al. ..... 211/49.1
4,519,504 A * 5/1985 Nausedas ..... 221/26
4,537,330 A * 8/1985 Gelbard ..... 211/26
4,595,389 A * 6/1986 Lehmacher ..... 221/26
5,096,089 A * 3/1992 McLaughlin ..... 221/26
5,119,968 A * 6/1992 Palmer ..... 221/27
5,806,099 A * 9/1998 Grinberg ..... 2/159
5,921,434 A * 7/1999 Hollander ..... 221/34
5,966,741 A * 10/1999 Klecina ..... 2/159

* cited by examiner

*Primary Examiner*—Kenneth W. Noland
(74) *Attorney, Agent, or Firm*—Schweitzer Cornman Gross & Bondell LLP

(57) ABSTRACT

A disposable glove suitable for the foodservice industry has front and back layers of plastic sealed along a periphery thereof, forming finger and a thumb portion in a closed end and an open end. A mounting section extends rearwardly from the back layer and includes mounting holes suitable to receive wickets therethrough. The mounting holes are also suitable for attaching the gloves to a portable planar support to form a portable and compact disposable glove cartridge which, when depleted, is easily replaced with a fresh cartridge. The disposable glove of the present invention is quickly and easily donned and removed from a dispenser (e.g., a glove rack) with a single motion of only a single hand, without assistance from the other hand.

4 Claims, 6 Drawing Sheets

GLOVE CARTRIDGE AND METHOD OF DONNING A DISPOSABLE GLOVE

RELATED APPLICATION

This application is a continuation-in-part of U.S. application Ser. No. 09/478,654, filed Jan. 6, 2000 now abandoned.

FIELD OF THE INVENTION

The present invention relates to a disposable thermoplastic glove system suitable for use in the foodservice and food handling industries.

BACKGROUND AND SUMMARY OF THE INVENTION

Disposable hand covers such as gloves and mitts are widely used in the food handling and service industries, as well as in other applications to provide protection for the user and to improve hygiene. Typically, disposable gloves and mitts are formed of two layers of thermoplastic film sealed around their periphery, forming a five finger glove or a multi-finger mitt. Gloves have separate and distinct portions for each finger, while mitts have one portion for the thumb and a single, separate portion for the other digits. An exemplary disposable mitt of this two-layered type and having a severable header is shown in Grinberg U.S. Pat. No. 5,806,099. For the purposes of the following disclosure, it is intended that the term glove includes mitts. Conventional methods of forming two ply disposable gloves or mitts are described in Bradfield U.S. Pat. No. 4,928,322.

In many applications, including the food handling and service industries, personnel don gloves and mitts very frequently. Typically, after a single or quite limited use, the disposable glove is discarded and a fresh glove is donned. Clearly, it is desirable that the disposable gloves be inexpensive and that the gloves be constructed and packaged such that they can be easily and quickly donned and replenished with a minimum effort and without contaminating or compromising the cleanliness of the freshly donned gloves. Known glove packaging arrangements for disposable gloves are shown in McLaughlin U.S. Pat. No. 4,844,293; Hoffrichter U.S. Pat. No. 5,655,682; and Klecena U.S. Pat. No. 5,966,741.

Disposable gloves may be held by so-called "wickets," including wicket posts, hooks, and rings. Wickets are commonly used devices for enabling the easy dispensing of disposable items, e.g., sandwich and grocery bags and the like. Wickets generally consist of one or more spaced vertical rods or other structures which extend through holes formed in tear-off portions of the items being dispensed. In this manner, items are conveniently stored proximate a workstation by stacking them on the wickets for relatively easy selection and removal. The present invention in one embodiment comprises a stack of easily donned disposable gloves which may be conveniently mounted to wickets, where the wickets are attached to a support structure.

In an alternate embodiment, the present invention is a disposable glove system which comprises a specially configured glove cartridge assembly. A glove cartridge includes a stack of disposable gloves mounted on a portable planar support, which support conveniently forms a wall of a glove package (which package generally consists of a glove cartridge shrink wrapped with a plastic wrap or the like). The portable planar support may have wickets mounted thereon, to which the gloves are attached. The planar support may instead have other attachment means, such as tie straps, for holding the gloves thereon. The cartridge may be received and secured by a permanent or semi-permanent support structure in a convenient location for holding the gloves proximate a workstation. Once a cartridge is depleted, it is replaced with a fresh cartridge. Alternately, an entire stack of gloves may be initially separated from the cartridge and thereafter attached to wickets mounted on a separate support structure. The gloves may also be advantageously designed without severable headers, adding speed and convenience to the process of replenishing the gloves after a stack has been depleted. The planar support may instead comprise an integral wall of a parallel piped package which may be opened and closed, as required, for accessing and storing a supply of gloves. Whatever the specific embodiment of the present invention, it is an important object and principle of the invention that the top glove of the stack always be readily and easily donned and removed by a single, simple linear motion of only one hand of a user, i.e. by simply slipping a hand into the glove, while the other hand is not used.

The improved gloves of the present invention are two ply disposable gloves formed of juxtaposed relatively short front and relatively long back sheets of plastic film typically heat welded together around the peripheral edges thereof and forming a closed end with separate portions for each finger and an open end adjacent the wrist portion. At the open end of a glove, the longer back sheet extends beyond the shorter front sheet, forming a mounting section which has a pair of "key-hole" mounting holes therein suitable for receiving wickets therethrough. Each mounting section includes either perforations extending longitudinally from the holes to the rear edge portion of the back sheet, or a single perforation extending axially from side to side, positioned between the mounting holes and the open end of the glove. In the former embodiment, the severable header is eliminated because no portion of the mounting section remains about the wickets after the glove is removed.

The glove opening is designed to allow the entire hand of a user to be inserted quickly and easily between the two layers of plastic film. In particular, the extended mounting section of the back sheet is not overlayed by the top sheet, providing a bare inner surface of the back sheet against which a hand may be slid easily into the glove opening. Each of the front and back sheets is preferably advantageously fabricated of a material having little elasticity, such as polyethylene, causing the glove opening to open immediately and causing the front and back sheets to separate quickly from each other with little effort by a user upon donning the glove.

Additional features and attendant advantages of the new glove package will be apparent from the following detailed description taken in conjunction with the accompanying drawings.

DETAILED DESCRIPTION OF THE INVENTION

Figure 2:
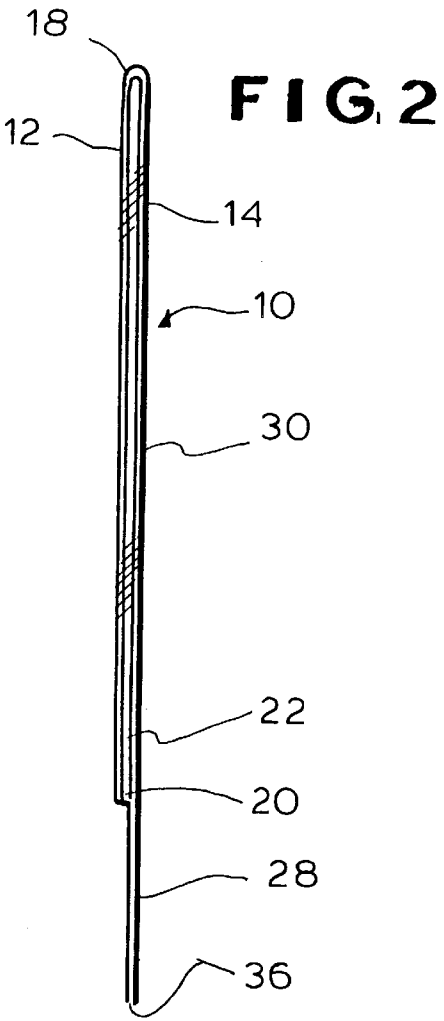
FIG. 2 is a side cross-sectional view, of taken along line 2—2 of FIG. 1.
Figure 1:
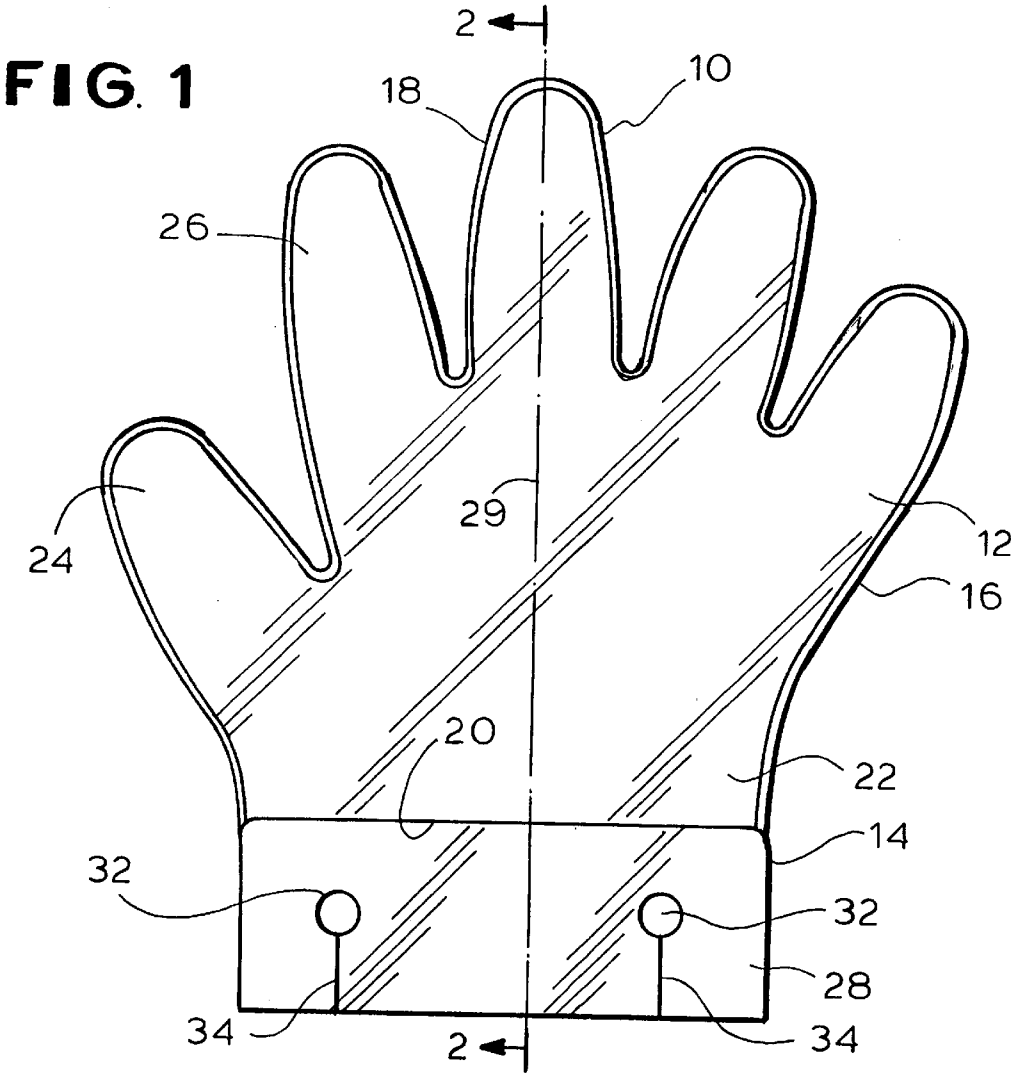
FIG. 1 is a top plan view of the glove of the present invention.

Referring to FIGS. 1 and 2, the glove 10 of the present invention includes front and back sheets 12, 14 of plastic film which are joined along their periphery 16 to form a closed end 18 and an open end 20 with a wrist portion 22. As shown, the front and back sheets 12, 14 can be shaped to form a thumb and finger portions 24, 26 corresponding to the shape of a hand.

The back sheet 14 includes an extended mounting section 28 which extends rearwardly from the open end 20 of the glove 10 in a direction opposite the closed end 18 thereof. Preferably, the mounting section 28 is integrally formed with a dorsal portion 30 of the back sheet 14, which dorsal portion 30 is positioned to cover the dorsal aspect of the hand, (i.e., the back of the hand). The mounting section 28 includes a plurality of mounting holes, 32 (or "key-holes") which are suitable to receive a fastener, such as wickets, for supporting the glove. The front and back sheets 12, 14 of the glove are preferably fabricated of a material having little elasticity, such as polyethylene, causing the glove opening to open immediately, and causing the front and back sheets to spread apart quickly, with little effort by a user upon sliding his or her hand into the open end 20 of the glove. The material of the glove is preferably durable as well as difficult to penetrate with sharp objects, providing added safety to the hands of users. The extended (mounting) section of the back sheet is not overlayed by the top sheet, providing a bare inner surface of the back sheet against which a hand may be easily slid into the glove opening 20.

Lines of weakness 34 in the material forming the mounting section 28, such as perforations, extend from the mounting holes 32 to the rearmost edge 36 of the mounting section 28. The lines of weakness are substantially parallel to the longitudinal axis 29 of the glove 10 and are aligned substantially toward the closed end 18 of the glove 10. In an alternate embodiment, each mounting section may instead have a single line of weakness which is substantially perpendicular to the longitudinal axis of the glove and is positioned between the mounting holes and the open end of the glove.

Figure 3:
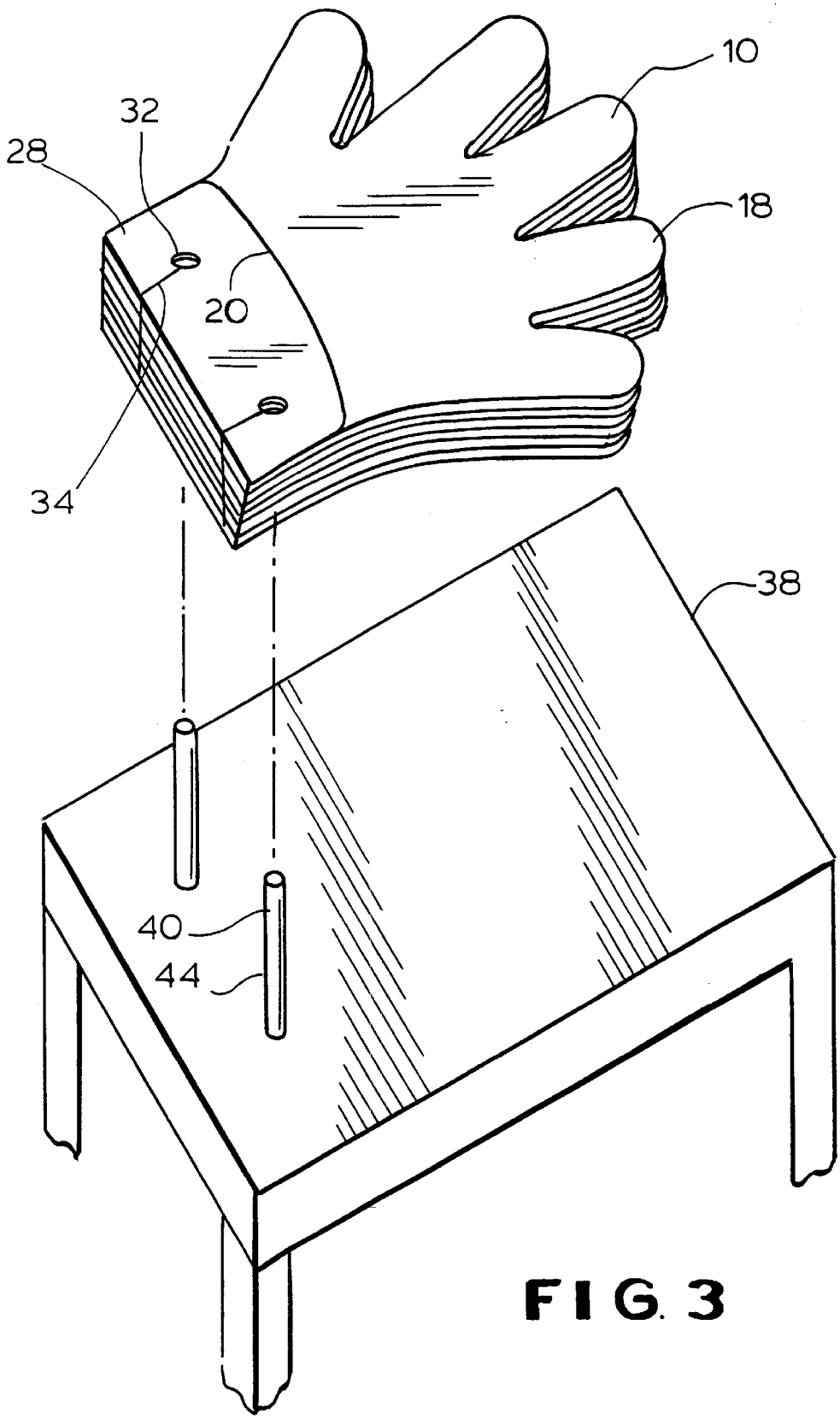
FIG. 3 is an assembly view of an embodiment of the invention having a stack of gloves and a permanent planar support with a pair of wickets.

Referring to FIG. 3, a plurality of gloves 10, in a stack, can be mounted on a support structure 38 by a number of fasteners 40. Here the fasteners 40 are in the form of straight wicket posts 44 affixed to a planar table; however, it is intended that other types of fasteners can also be employed. The gloves 10 are mounted directly on the support structure 38 by directing the fasteners 40 through the mounting holes 32 within the mounting section 28 of the gloves 10.

Figure 4:
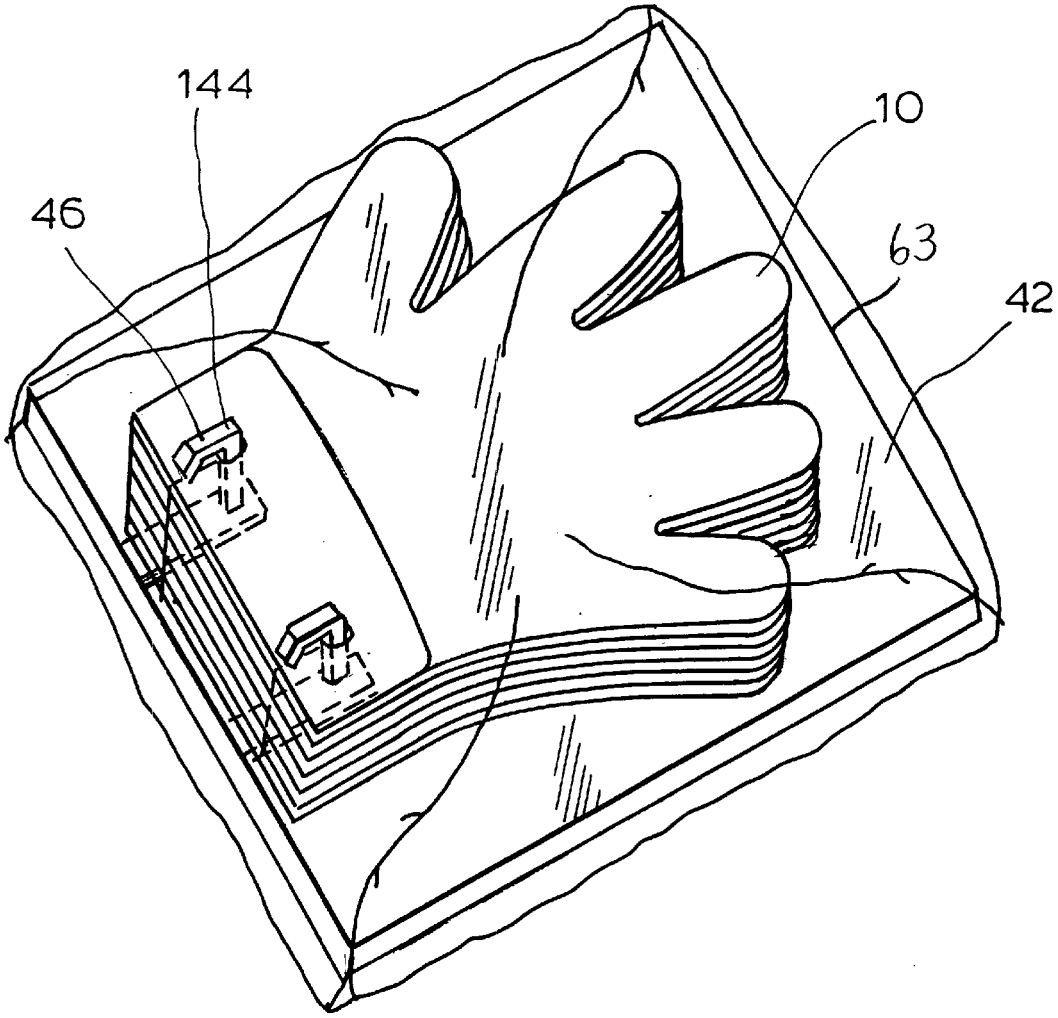
FIG. 4 is a perspective view of an embodiment of the invention having a stack of gloves mounted on a portable planar support by wickets.

Referring to the embodiment of FIG. 4, individual gloves 10 are mounted on a portable planar support 42 (or panel), such as a section of paperboard or the like, by wickets 144. As shown, each wicket 144 can have an inverted J-shape 46. The gloves 10 and planar support 42 can be shrink wrapped for shipping and storage. In an alternate embodiment, the gloves in a stack are heat-welded to each other along their respective mounting sections to form an integral stacked unit of gloves. The combination of the gloves and a planar support constitutes a single glove cartridge.

A stack of gloves may instead be attached to a portable planar support by tie-straps, which extend through the gloves' mounting holes and attach to the planar support to form a glove cartridge. Additional types of attachment means may instead be employed, e.g., heavy duty staples, for attaching the gloves to the planar support. Each cartridge preferably initially includes between 10 and 200 individual gloves.

Figure 5:
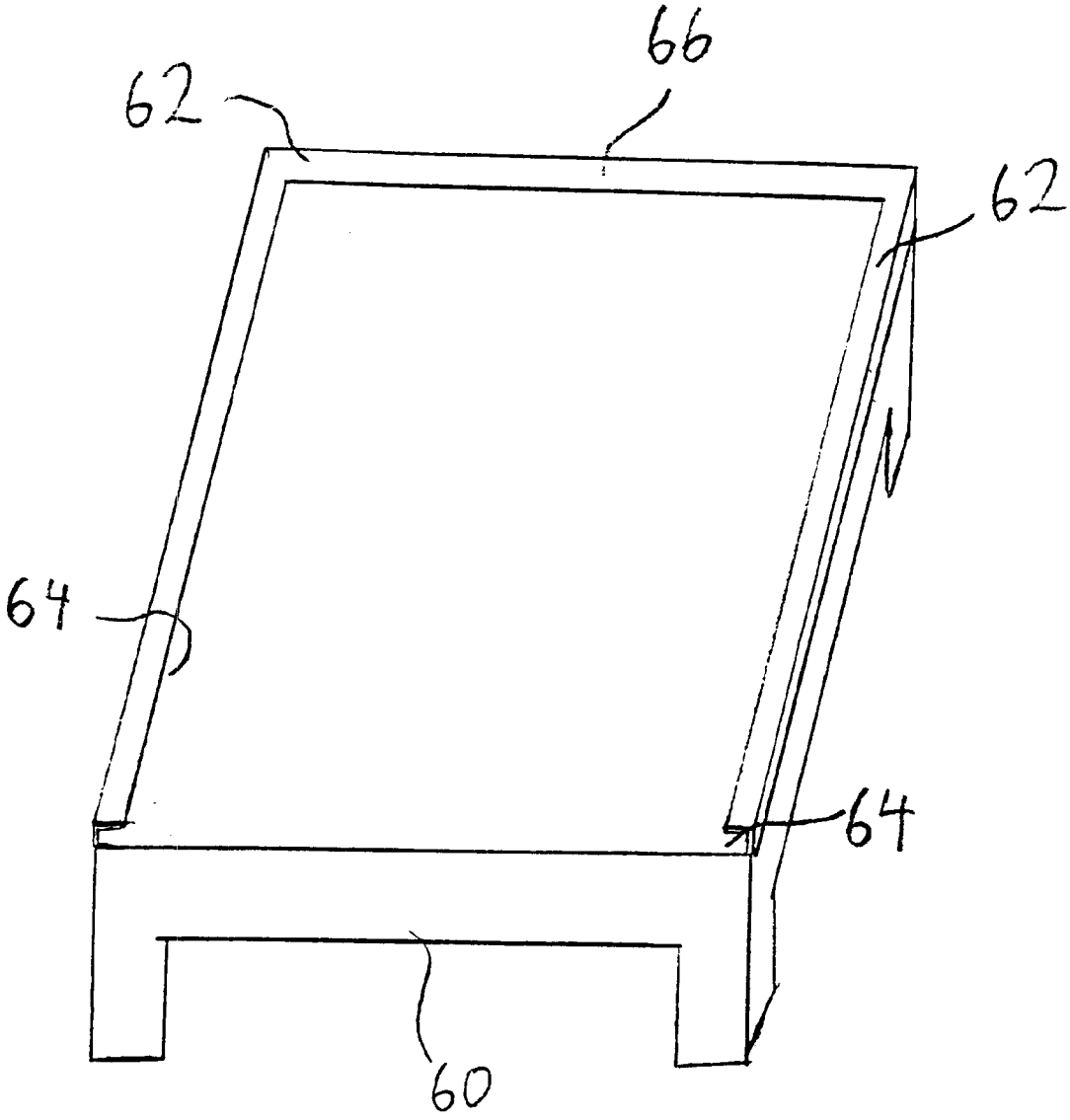
FIG. 5 is a perspective view of a mounting mechanism attached to a permanent support structure.
Figure 6:
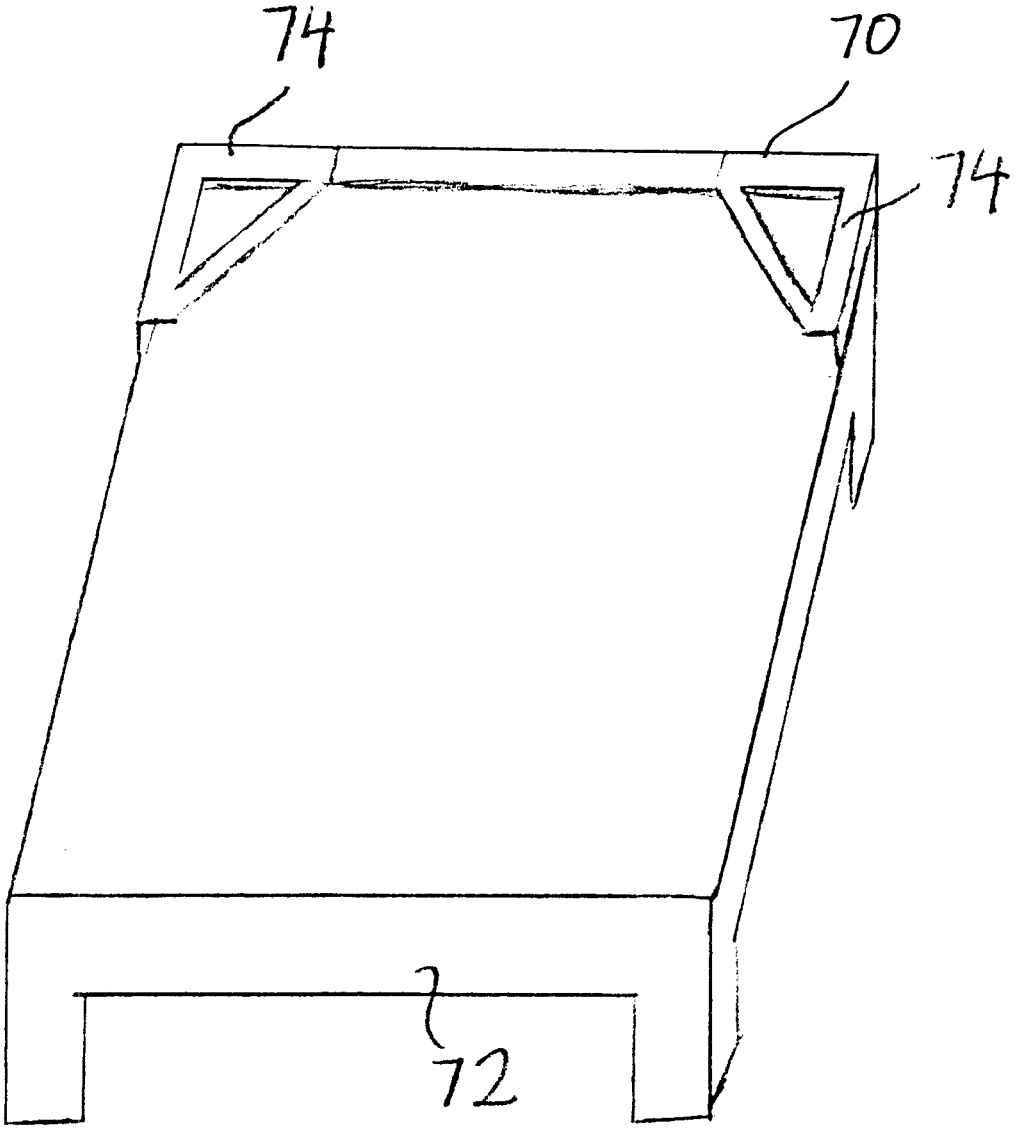
FIG. 6 is a perspective view of an alternate embodiment of the mounting mechanism of FIG. 5 attached to a permanent support structure.

The mounting mechanism of FIG. 5 may be easily used with the glove cartridges. A permanent support structure 60 (such as a counter-top) has a U-shaped frame 62 mounted thereon, which frame is permanently or semi-permanently attached to the permanent support structure 60. The frame 62 is shown oriented horizontally but may alternately be oriented vertically, depending on the user's preference. The U-shaped frame 62 is specially configured to receive the glove cartridge. Specifically, the leading edge (shown by the reference numeral 63 of FIG. 4) of the planar support of a cartridge may be slid into a receiving groove 64 of the frame, whereupon the closed end of the gloves is positioned near the central portion 66 of the frame. The central portion 66 abuts the leading edge of the planar support, thus holding the glove cartridge securely in place upon donning a glove. An alternate design of a mounting mechanism 70, for mounting a cartridge to a permanent support structure 72, is shown in FIG. 6. Brackets 74 are mounted to a permanent support structure in order to secure two corners of a planar support of a glove cartridge to the permanent support structure, whereby the cartridge is similarly slid into and out of the brackets 74 for the replenishing of gloves.

Figure 7:
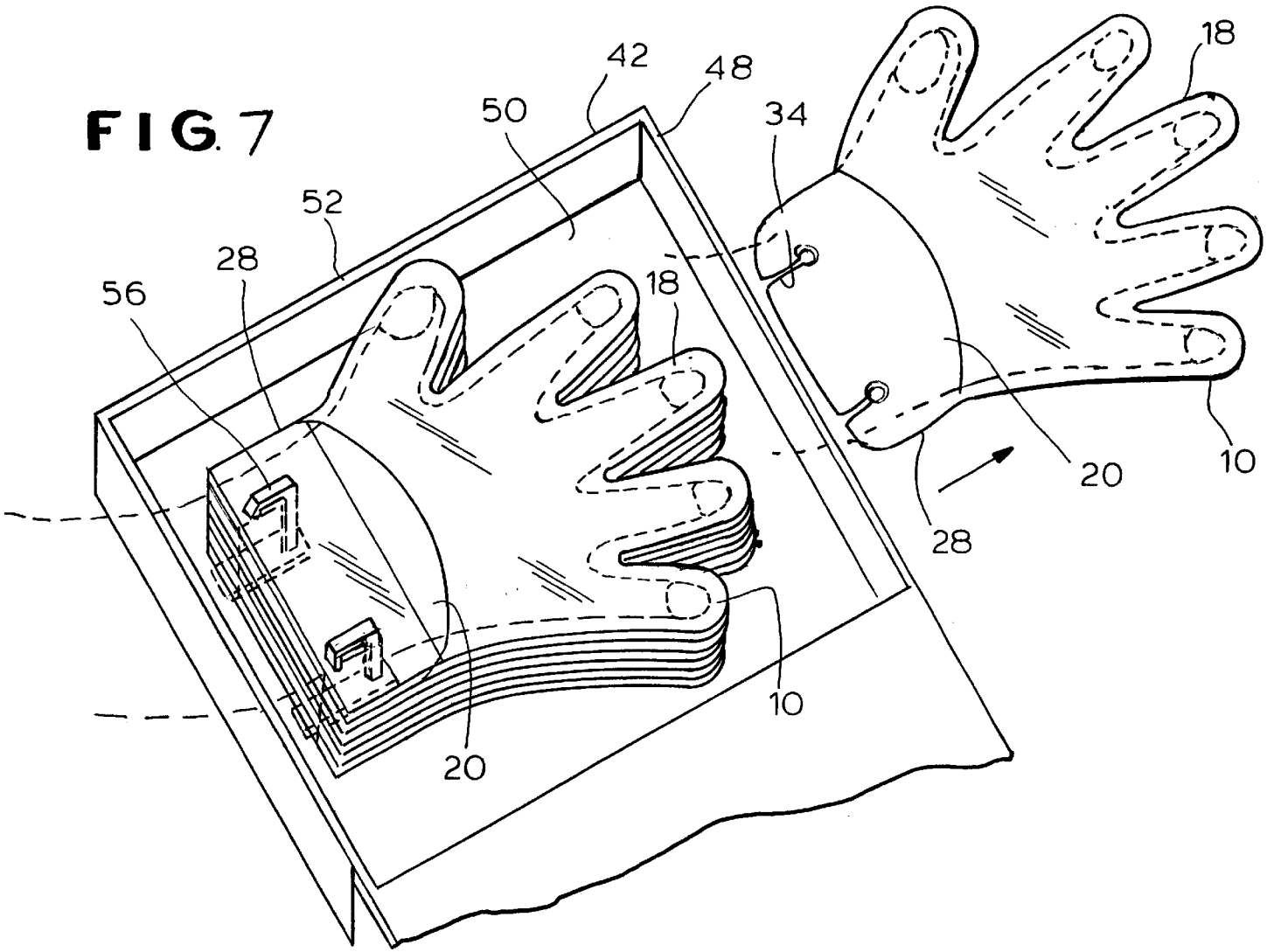
FIG. 7 is a perspective view of an embodiment of the invention having a stack of gloves mounted to a disposable enclosure.

Referring to FIG. 7, a portable support structure 42 can be in the form of a box 48 having a base 50 four side walls 52 and a cover 54. Wickets 56, such as those described with reference to FIG. 4, can be affixed to the base 50 for securing the gloves 10.

In donning a glove, a user inserts a hand into the open end 20 of the top glove of a stack and urges the glove forward toward the closed (finger) end 18 of the glove, in a direction substantially parallel to the longitudinal axis of the glove. The glove opening advantageously opens immediately with little effort by a user upon sliding his or her hand into the glove. The forward motion creates tension in the mounting section 28 of the glove, causing the lines of weakness 34 in the mounting section 28 separate, thus releasing the glove from the wickets 56. It can be appreciated that when the lines of weakness are positioned longitudinally and the entire glove 10 is released from the wicket 56, no portion of the glove 10 remains behind upon donning.

Although the glove in FIGS. 1–7 may be worn on either the right or left hand, it is more easily donned by the right hand (the glove may also be donned by the left hand by turning one's left hand palm-up while donning the glove). A stacked unit of left-handed gloves that are the mirror image of the glove of FIGS. 1–7, but otherwise identical, may also be manufactured to allow a user to don gloves onto both hands in the more ergonomic palm-down manner. The strength of the material forming the mounting section 28 and the reduction in such strength caused by the lines of weakness 34 can be adjusted to create an optimal design. The specially configured glove cartridges of the present invention provide an economical and compact pre-packaged unit which may be conveniently sold and transported.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. An easy-to-don disposable glove, comprising:

(a) a glove body formed of a front layer of plastic sealed to a back layer of plastic around the respective periphery thereof forming a closed end and an open end, and forming a portion for the thumb and one or more portions for the fingers of the user;

(b) a mounting section extending from said open end of said glove body, said mounting section including an edge and at least one mounting hole located between said open end of said glove and said edge, said mounting hole being suitable for receiving a fastener therethrough; and (c) said mounting section including a line of weakness for releasing the glove from said fastener;

(d) whereby said glove can be efficiently donned and removed from the fastener by inserting a hand directly into a fastened glove and applying force to the glove in a direction of donning, thereby separating said line of weakness and separating the glove from the fastener.

2. The disposable glove of claim 1, wherein the glove is fabricated of a thermoplastic film having little elasticity for increasing the ease of donning the glove.

3. The disposable glove of claim 1, wherein said glove is associated and stacked into a unit of identical gloves, said stacked unit of said gloves is mounted to a portable support having a base, and at least one fastener is attached to said base, wherein said fastener is suitable for being received through said mounting hole and said glove being removable from said glove support by inserting a hand directly into the open end of the glove and applying force thereto in a direction of donning, thereby causing said line of weakness to separate and release said glove from said fastener.

4. The disposable glove of claim 3, wherein each glove of said stacked unit is attached to at least one other glove.

* * * * *